US005135610A

United States Patent [19]

Tytgat et al.

[11] Patent Number: 5,135,610

[45] Date of Patent: Aug. 4, 1992

[54] BATHS AND PROCESS FOR CHEMICAL POLISHING OF STAINLESS STEEL SURFACES

[75] Inventors: Daniel Tytgat, Brussels; Marianne Reignier, Nivelles; François Dujardin, Brussels, all of Belgium

[73] Assignee: Solvay & Cie, Brussels, Belgium

[21] Appl. No.: 453,246

[22] Filed: Dec. 19, 1989

Related U.S. Application Data

[63] Continuation of Ser. No. 128,162, Dec. 3, 1987, abandoned.

[30] Foreign Application Priority Data

Dec. 15, 1987 [FR] France ..... 86 17621

[51] Int. Cl.[5] ..... C23F 3/00

[52] U.S. Cl. ..... 156/664; 156/903; 252/79.1; 252/79.4; 134/3

[58] Field of Search ..... 252/79.4, 79.5, 79.2, 252/79.3, 79.1; 156/664, 903; 134/3

[56] References Cited

U.S. PATENT DOCUMENTS 2,564,753 8/1951 Cox .
2,662,814 12/1953 Swihart .
3,072,515 1/1963 Smolinski .
3,457,107 7/1969 Mickelson et al. .
3,839,112 10/1974 Arciniega .
4,060,496 11/1977 Berliner ..... 252/79.1 X
4,510,018 4/1985 McGowan ..... 252/79.4 X

FOREIGN PATENT DOCUMENTS 734665 8/1955 United Kingdom .
0019964 12/1980 European Pat. Off. .

OTHER PUBLICATIONS

Chemical abstracts, vol. 82, No. 2, Jan. 13, 1975, p. 142 Ref. 6539X.
Chemical Abstracts, vol. 77, No. 20, Nov. 13, p. 193 Ref. 12956T.

*Primary Examiner*—Thi Dang
*Attorney, Agent, or Firm*—Stevens, Davis, Miller & Mosher

[57] ABSTRACT

Baths for the chemical polishing of stainless steel surfaces containing, in aqueous solution, a mixture of hydrochloric acid, phosphoric acid, nitric acid and of sulphosal cylic acid and at least one abietic compound.

11 Claims, No Drawings

BATHS AND PROCESS FOR CHEMICAL POLISHING OF STAINLESS STEEL SURFACES

This application is a continuation of application Ser. No. 128,162, filed Dec. 3, 1987, now abandoned.

The present invention relates to the composition of baths for the chemical polishing of stainless steel surfaces.

Chemical polishing of metal surfaces is a well-known technique (Polissage électrolytique et chimique des métaux [electrolytic and chemical polishing of metals-]—W. J. McG. Tegart—Dunod—1960—p. 122 et seq.); it consists in treating the metal surfaces to be polished with oxidizing baths. Baths comprising a mixture of hydrochloric, phosphoric and nitric acids, in aqueous solution (U.S. Pat. No. 2,662,814) are generally employed for the chemical polishing of austenitic stainless steels. In order to improve the quality of the polish, it is usual to incorporate in these baths appropriate additives such as surface-active agents, viscosity regulators and brightening agents. Thus, in U.S. Pat. No. 3,709,824, a composition of a bath for the chemical polishing of stainless steel surfaces is provided, comprising, in aqueous solution, a mixture of phosphoric acid, nitric acid and hydrochloric acid, a viscosity regulator chosen from water-soluble polymers, a surfactant and sulphosalicylic acid as a brightening agent.

These known polishing baths have the particular characteristic of etching the metal at a very high rate. A polishing treatment of a stainless steel surface with such baths cannot generally exceed a few minutes, at the risk of giving rise to local corrosive attacks. This high rate of action of known polishing baths is a disadvantage, because it renders them unusable for certain applications, especially for polishing the inner face of the walls of large-sized vessels such as boilers, autoclaves or crystallizers. Since the time required for filling and emptying such vessels is generally much longer than the optimum duration of the chemical polishing treatment, it becomes impossible, in fact, to obtain a uniform polish on the wall, certain regions of the latter being inadequately polished, and others being deeply corroded. Furthermore, the high rate of action of known chemical polishing baths makes the polishing difficult to control. Moreover, these known baths are useless for polishing surfaces in contact with which the renewal of the bath is difficult, because this results in abrupt changes in the local compositions of the bath. They are not suitable for polishing equipment in which the surface area of the surface to be polished is very large in comparison with the capacity available for the bath, for example heat exchangers with a very large exchange surface.

Patent EP-B 19,964 (Solvay & Cie) proposes very slow-acting chemical polishing baths which consequently avoid the abovementioned disadvantages. These baths consist of a mixture, in suitable proportions, of hydrochloric, phosphoric and nitric acids, sulphosalicylic acid, alkylpyridinium chloride and methyl cellulose. They have been found to be especially suitable for the slow polishing of homogeneous surfaces of austenitic stainless steel, particularly of grades ASTM-304L or ASTM-316L, which are chromium and nickel alloy steels.

Other compositions of baths for slow chemical polishing of stainless steel surfaces, particularly of austenitic grades, have now been found, which make it possible not only to obtain a superior polish, but also to polish simultaneously surfaces of steels of different grades, as can be the case, for example, with riveted, welded or bolted assemblies, without the risk of galvanic corrosion.

The invention consequently relates to baths for the chemical polishing of stainless steel surfaces, comprising, in aqueous solution, a mixture of hydrochloric acid, phosphoric acid and nitric acid, and of sulphosalicylic acid; according to the invention the baths comprise, in the aqueous solution, at least one soluble abietic compound.

In the baths according to the invention, the abietic compound is a chemical compound containing an abietyl radical of general formula:

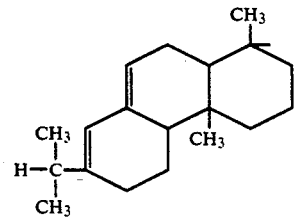

or a hydroabietyl or dehydroabietyl radical.

In accordance with the invention, the abietic compound must be soluble in the aqueous solution.

Abietic compounds which can be employed in the baths according to the invention are abietamines.

Abietamines which are specially recommended for the baths according to the invention are those of general formula:

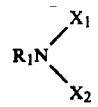

in which:

$R_1$ denotes an abietyl, hydroabietyl or dehydroabietyl radical as defined above, $X_1$ denotes a radical containing at least one carbonyl group, and $X_2$ denotes a hydrogen atom or a radical containing at least one carbonyl group.

Examples of such abietamines, which are suitable in the baths according to the invention, are those in which at least one of the radicals $X_1$ and $X_2$ is a radical of general formula:

$$-CH_2-R_2$$

in which $R_2$ denotes a saturated or unsaturated, substituted or unsubstituted, straight-chain or cyclic alkyl moiety, containing at least one carbonyl group. Among these compounds, preference is given to those in which the group $-CH_2-$ is linked to a carbonyl group of the $R_2$ moiety via a carbon atom carrying at least one hydrogen atom. Such substituted abietamines and the means for obtaining them are described in patent GB-A-734,665. Examples of abietamines of this type, which can be employed in the baths according to the invention, are those in which the alkyl moiety $R_2$ is chosen from the acetonyl, 2-ketobutyl, 4-methyl-2-keto-3-pentenyl, 4-hydroxy-4-methyl-2-ketopentyl, 2-ketocyclopentyl, 4-hydroxy-2-keto-3-pentenyl, 2-ketocyclohexyl, 2,5-diketohexyl and 2-phenyl-2-ketoethyl moieties.

In the chemical polishing baths according to the invention, the respective contents of hydrochloric, phosphoric and nitric acids, of sulphosalicylic acid and of abietic compound are chosen depending on the nature of the metal treated, of the working temperature and of the desired duration of the polishing treatment. Baths according to the invention which are suitable for ensuring the chemical polishing of chromium and/or nickel alloy stainless steel surfaces, in a time of between 2 and 24 hours, are those in which the aqueous solution comprises, per liter, between 1 and 6 moles of hydrochloric acid, between 0.01 and 1 mole of phosphoric acid, between 0.005 and 0.5 mole of nitric acid, between 0.05 and 20 g of sulphosalicylic acid and between 0.001 and 3 g of the abietic compound. Baths which are especially advantageous are those in which the overall molarity of the mixture of hydrochloric, phosphoric and nitric acids is between 1 and 7, preferably 1.8 and 6, the content of sulphosalicylic acid, expressed in g/l of the aqueous solution, being between 0.05 and 1.5 times the overall normality of the mixture of hydrochloric, phosphoric and nitric acids.

In a particular form of embodiment of the baths according to the invention, the latter additionally comprise an alcohol, an ether or an ether-alcohol dissolved in the aqueous solution. The optimum quantity of this additional compound in the aqueous solution of the bath depends on various parameters, particularly on the said additional compound, on the abietic compound chosen and on the concentrations of the bath constituents. In practice, concentrations of this additional compound of between 0.001 and 10 g per liter of aqueous solution are suitable.

With all other parameters unchanged, the baths according to this form of embodiment of the invention make it possible to produce surface polishes of higher quality, which are characterized particularly by a higher brightness.

The polishing baths, according to the invention may optionally contain additives which are usually present in the known baths of the chemical polishing of metals, for example surface-active agents and viscosity regulators.

Baths according to the invention which are especially suitable for the slow polishing of austenitic stainless steel surfaces comprise, per liter of aqueous solution of the bath:

between 2 and 5 moles of hydrochloric acid,
between 0.02 and 0.5 mole of phosphoric acid,
between 0.01 and 0.2 mole of nitric acid,
between 0.1 and 10 g of sulphosalicylic acid,
between 0.010 and 2.5 g of the abietic compound,
between 0.002 and 5 g of alcohol, ether or ether-alcohol, and
between 0.005 and 6 g of surface-active agent.

A great advantage of the polishing baths according to the invention lies in their ability, after the respective concentrations of their constituents have been adapted, to produce polishes at a moderate rate of action, which can be distributed over several hours, so as to permit the uniform polishing of surfaces of large dimensions or of surfaces to which access is difficult. They are especially highly suitable for the polishing of metal surfaces whose surface area is very large, when compared with the capacity available for the bath. By way of example, they find an advantageous application in the polishing of metal surfaces whose surface area (expressed in $m^2$) is between 1 and 10 times the volume (expressed in $m^3$) of the polishing bath with which it is in contact.

The baths according to the invention are suitable for polishing any austenitic stainless steel surfaces. They find an especially advantageous application in the polishing of chromium and nickel alloy austenitic stainless steels, particularly those containing between 12 and 26% of chromium, between 6 and 30% of nickel and between 0 and 6% of molybdenum, such as, for example, 18/8 and 18/10/2.5 steels.

Furthermore, the baths according to the invention find an advantageous application in the polishing of assemblies of steels of different grades, particularly welded assemblies, without giving rise to local galvanic corrosive attacks on the assembly. By way of example, they permit the polishing of welded assemblies combining components made of 18/8 grade chromium and nickel alloy steels (ASTM-304 and 304L) with components made of 18/10/2.5 grade chromium, nickel and molybdenum alloy steels (ASTM-316 and 316L).

The invention also relates to a process for the polishing of a stainless steel surface, according to which the surface is placed in contact with a chemical polishing bath in accordance with the invention.

In the process according to the invention, the polishing bath may be employed at any temperatures and pressures at which its constituents do not run the risk of deteriorating. Nevertheless, it has been found advantageous to employ the bath at atmospheric pressure, at a temperature above 25° C. and below 100° C., temperatures between 50° and 80° C. being most preferred.

The placing of the metal surface in contact with the bath may be performed in any suitable manner, for example by immersion.

In the process according to the invention, the contact time between the surface to be polished and the bath must be sufficient to produce an effective polishing of the surface; it cannot, however, exceed a critical value beyond which there is a risk that local corrosive attacks may appear on the surface. The optimum contact time depends on many parameters such as the metal or the alloy of which the surface to be polished consists, the configuration and the initial roughness of the latter, the bath composition, the working temperature, possible turbulence of the bath in contact with the surface, and the relationship between the surface area of the metal surface to be polished and the volume of the bath employed; it must be determined for each particular case by means of a routine laboratory task.

In a particular form of embodiment of the process according to the invention, after the metal surface has been placed in contact with the bath, a complementary quantity of nitric acid is added to the bath in order to regenerate it. The addition of the complementary quantity of nitric acid may be performed continuously or at intervals. It is adjusted in order to maintain the concentration of nitric acid in the bath continually in a range of values which are compatible with an optimum polishing of the metal surface.

The advantage of the invention will become apparent on reading the examples of application which are given below.

EXAMPLE 1

A panel, 21.50 $cm^2$ in surface area, of ASTM-304L grade stainless steel (chromium(18.0 to 20.0%) and nickel (8.0 to 12.0%) alloy steel) was immersed in 500 $cm^3$ of a bath at 55° C. containing, per liter:

3 moles of hydrochloric acid,
0.15 mole of phosphoric acid,
0.01 mole of nitric acid,
0.5 g of sulphosalicylic acid, and
1 g of the product "Rodine 213" (Amchem Products Inc.) (mixture of substituted abietamines, isopropanol and surface-active agents.

The panel initially had an arithmetic mean roughness $R_a$=0.27 micron.

After 13 hours' treatment (the bath being continually agitated), an average depth of etching of the metal by bath was found by measurement to be equal to 20 microns. At this time, the panel was withdrawn from the bath and was washed with water and dried. It had a smooth and bright appearance. Its brightness (ASTM Standard E430) and its arithmetic mean roughness ($R_a$) were measured:

brightness: 22%
$R_a$: 0.13 micron.

EXAMPLE 2

The test described in Example 1 was repeated under the following conditions:

Panel of ASTM-316L grade stainless steel (chromium (16.0 to 18.0%), nickel (10.0 to 14.0%) and molybdenum (2.0 to 3.0%) alloy steel).

Surface area of the panel: 50 $cm^2$.

Composition of the polishing bath (quantities normalized to 1 l of bath):

2.7 moles of hydrochloric acid,
0.2 mole of phosphoric acid,
0.02 mole of nitric acid,
1 g of sulphosalicylic acid,
1 g of product "Rodine 213", and
2 g of the product "Triton N101" (Rohm & Haas Co.) (mixture of surfactants based on alkylaryl polyether alcohols).

Bath temperature: 65° C.
Volume of the bath: 1,250 $cm^3$.
Duration of the treatment: 6 hours.
The panel had an initial roughness $R_a$=0.28 micron.
At the end of the treatment, measurements showed:
a depth of etching: 22 microns,
a brightness of 35%, and
a roughness $R_a$=0.09 micron.

EXAMPLE 3

The test described in Example 1 was repeated, under the following conditions:

Panel of ASTM-430 grade martensitic stainless steel (chromium (16.0 to 18.0%) alloy steel in which the concentrations of nickel and of carbon do not exceed 0.75% and 0.12% respectively).

Surface area of the panel: 22.50 $cm^2$.

Composition of the polishing bath (quantities normalized to 1 l of bath):

2.7 moles of hydrochloric acid,
0.2 mole of phosphoric acid,
0.02 mole of nitric acid,
3 g of sulphosalicylic acid,
1 g of the product "Rodine 213" (defined in Example 1), and
2 g of the product "Triton N101" (defined in Example 2).

Bath temperature: 65° C.
Volume of the bath: 500 $cm^3$.
Duration of the treatment: 10 hours.
The panel had an initial roughness $R_a$=0.70 micron.
At the end of the treatment, measurements showed:
a depth of etching: 25 microns,
a brightness of 12% and
a roughness $R_a$=0.22 micron.

EXAMPLE 4

The test described in Example 1 was repeated under the following conditions:

Assembly of two rectangular panels made of stainless steel, welded along a common ridge:

a panel, 30 $cm^2$ in surface area of ASTM-304L grade steel,
a panel, 30 $cm^2$ in surface area, of ASTM-316L grade steel.

Composition of the polishing bath (quantities normalized to 1 l of bath):

4 moles of hydrochloric acid,
0.1 mole of phosphoric acid,
0.02 mole of nitric acid,
1 g of sulfosalicylic acid,
1 g of the product "Rodine 213", and
1.3 $cm^3$ of a mixture of isopropanol and n-propanol.

Bath temperature: 65° C.
Volume of the bath: 1000 $cm^3$.
Duration of the treatment: 10 hours.
The panels of the assembly had the following initial roughnesses:
ASTM-304L panel: $R_a$=0.29 micron,
ASTM-316L panel: $R_a$=0.28 micron.

When recovered to the end of the treatment, the assembly had a smooth and bright appearance, without any trace of corrosion. The depth of etching, the brightness and the roughness were measured on each panel:

ASTM-304L panel: depth of etching: 27 microns,
brightness: 21%.
roughness $R_a$=0.13 micron,
ASTM-316L panel: depth of etching: 22 microns,
brightness: 22%.
roughness $R_a$=0.11 micron.

We claim:

1. Baths for the chemical polishing of stainless steel surfaces, comprising, in aqueous solution, a mixture of hydrochloric acid, phosphoric acid and nitric acid, and of sulphosalicylic acid, characterized in that they comprise, in the aqueous solution, at least one soluble abietic compound and the mixture contains, respectively, per liter of aqueous solution, between 1 and 6 moles of said hydrochloric acid, between 0.01 and 1 mole of said phosphoric acid, between 0.005 and 0.5 mole of said nitric acid, between 0.05 and 20 g of said sulphosalicylic acid, and between 0.001 and 3 g of said abietic compound.

2. Baths according to claim 1, wherein the abietic compound is a substituted abietamine of general formula:

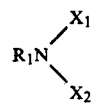

in which:

$R_1$ denotes an abietyl, hydroabietyl or dehydroabietyl radical, $X_1$ denotes a radical containing at least one carbonyl group, and $X_2$ denotes a hydrogen atom or a radical containing at least one carbonyl group.

3. Baths according to claim 2, wherein at least one of the radicals $X_1$ and $X_2$ is a moiety of general formula:

$$-CH_2-R_2$$

where $R_2$ denotes a saturated or unsaturated, substituted or unsubstituted, straight-chain or cyclic alkyl moiety containing at least one carbonyl group.

4. Baths according to claim 3, wherein, in the radical of general formula:

$$-CH_2-R_2$$

the group $-CH_2-$ is linked to a carbonyl group of the $R_2$ moiety via a carbon atom carrying at least one hydrogen atom.

5. Baths according to claim 4, wherein the alkyl moiety $R_2$ is chosen from the group consisting of acetonyl, 2-ketobutyl, 4-methyl-2-keto-3-pentenyl, 4-hydroxy-4-methyl-2-ketopentyl, 2-ketocyclopentyl, 4-hydroxy-2-keto-3-pentenyl, 2-ketocyclohexyl, 2,5-diketohexyl and 2-phenyl-2-ketoethyl moieties.

6. Baths according to claim 1, wherein they additionally comprise an alcohol, an ether or an ether-alcohol dissolved in the aqueous solution.

7. Baths according to claim 6, wherein they contain, per liter of aqueous solution, between 2 and 5 moles of said hydrochloric acid,
between 0.02 and 0.5 mole of said phosphoric acid,
between 0.01 and 0.5 mole of said nitric acid,
between 0.1 and 10 g of said sulphosalicylic acid,
between 0.1 and 2.5 g of said abietic compound,
between 0.002 and 5 g of said alcohol, ether or ether-alcohol, and further contain
between 0.005 and 6 g of a surface-active agent.

8. Process for polishing a stainless steel surface, wherein the surface is placed in contact with a chemical polishing bath, wherein said bath is a bath according to claim 1.

9. Process according to claim 8, wherein the bath is employed at a temperature of between 40° and 80° C.

10. Process according to claim 8, wherein after the steel surface has been placed in contact with the bath, a complementary quantity of nitric acid is added to the bath.

11. Baths for the chemical polishing of stainless steel surfaces, consisting essentially of, in aqueous solution, a mixture of hydrochloric acid, phosphoric acid and nitric acid, and of sulphosalicylic acid, characterized in that they consist essentially of, in the aqueous solution, at least one soluble abietic compound and the mixture contains, respectively, per liter of aqueous solution, between 1 and 6 moles of said hydrochloric acid, between 0.01 and 1 mole of said phosphoric acid, between 0.005 and 0.5 mole of said nitric acid, between 0.05 and 20 g of sulphosalicylic acid, and between 0.001 and 3 g of said abietic compound.

* * * * *